US011832751B2

(12) United States Patent
Gatke

(10) Patent No.: US 11,832,751 B2
(45) Date of Patent: Dec. 5, 2023

(54) PACKAGE RECEIVING DEVICE

(71) Applicant: Paul Gatke, Jacksonville, FL (US)

(72) Inventor: Paul Gatke, Jacksonville, FL (US)

( * ) Notice: Subject to any disclaimer, the term of this patent is extended or adjusted under 35 U.S.C. 154(b) by 0 days.

(21) Appl. No.: 17/446,136

(22) Filed: Aug. 26, 2021

(65) Prior Publication Data

US 2022/0151422 A1 May 19, 2022

Related U.S. Application Data

(60) Provisional application No. 63/070,848, filed on Aug. 27, 2020.

(51) Int. Cl.

*A47G 29/16* (2006.01)
*A47G 29/14* (2006.01)
*A47G 29/22* (2006.01)

(52) U.S. Cl.

CPC ..... *A47G 29/16* (2013.01); *A47G 29/141* (2013.01); *A47G 29/22* (2013.01); *A47G 2029/148* (2013.01)

(58) Field of Classification Search

CPC ..... A47G 29/16; A47G 29/141; A47G 29/20; A47G 29/22; A47G 29/28; A47G 29/12095; A47G 2029/148; E06B 7/32; B65G 11/04; B65G 2201/0285

USPC ..... 232/19, 22, 24, 43.4, 45; 109/66, 68; 193/8; 49/68

See application file for complete search history.

(56) References Cited

U.S. PATENT DOCUMENTS

| | | | | |
|---|---|---|---|---|
| 6,378,769 | B1 * | 4/2002 | Wolgamot | E06B 7/32 232/19 |
| 10,413,106 | B1 * | 9/2019 | Valeriano | A47G 29/141 |
| 11,278,144 | B2 * | 3/2022 | Vernal Silva | A47G 29/20 |
| 11,346,150 | B1 * | 5/2022 | Johnston | E06B 7/32 |
| 11,399,648 | B2 * | 8/2022 | Lewis | A47G 29/22 |
| 2003/0006275 | A1 * | 1/2003 | Gray | A47G 29/14 232/19 |
| 2014/0190081 | A1 * | 7/2014 | Wanjohi | A47G 29/126 49/504 |
| 2017/0213187 | A1 * | 7/2017 | Choi | G06K 7/10297 |
| 2018/0199745 | A1 * | 7/2018 | Charbeneau | A47G 29/141 |
| 2018/0317687 | A1 * | 11/2018 | Crooks | A47G 29/22 |
| 2019/0180544 | A1 * | 6/2019 | Newcomb | G07C 9/00896 |
| 2019/0248582 | A1 * | 8/2019 | Nevison | G05B 15/02 |
| 2019/0282015 | A1 * | 9/2019 | High | A47G 29/141 |
| 2019/0345758 | A1 * | 11/2019 | Drost | E06B 7/32 |
| 2020/0154922 | A1 * | 5/2020 | Jeffs | A47G 29/28 |
| 2020/0308903 | A1 * | 10/2020 | Anderson | E05F 15/76 |

(Continued)

*Primary Examiner* — William L Miller

(57) ABSTRACT

A specially designed package receiving device configured to facilitate automatic receipt and notification of packages while preventing unauthorized ingress and egress therethrough. The package receiving device includes a frame affixed to an existing support surface, an access panel pivotally coupled to the frame and being selectively rotated along clockwise and counterclockwise directions, a handle affixed to an upper exterior section of the access panel, a plurality of slats pivotally affixed to an interior side of the frame, a box for mail pivotally coupled to the interior side of the upper panel, and a dampening mechanism for providing greater resistive force against rotation of the access panel in the clockwise direction and less resistive force against rotation of the access panel in the counterclockwise direction.

6 Claims, 3 Drawing Sheets

Package Receiving Device

(56) References Cited

U.S. PATENT DOCUMENTS

| | | | | |
|---|---|---|---|---|
| 2020/0352376 | A1* | 11/2020 | Vernal Silva | A47G 29/1218 |
| 2021/0005033 | A1* | 1/2021 | Roman | G06Q 10/0833 |
| 2021/0038004 | A1* | 2/2021 | Graña Domínguez | E06B 7/32 |
| 2021/0045564 | A1* | 2/2021 | Duckers | E05F 15/673 |
| 2021/0059456 | A1* | 3/2021 | Fontanilla | A47G 29/16 |
| 2021/0079720 | A1* | 3/2021 | Hunt | E06B 7/28 |
| 2021/0082219 | A1* | 3/2021 | Kane | G07C 9/00182 |
| 2021/0177182 | A1* | 6/2021 | Plummer | A47G 29/28 |
| 2021/0230926 | A1* | 7/2021 | Schler | G06Q 30/0601 |
| 2021/0363816 | A1* | 11/2021 | Daniels | E06B 7/34 |
| 2022/0031105 | A1* | 2/2022 | Newcomb | G06Q 10/0833 |
| 2022/0058575 | A1* | 2/2022 | Moudy | H04L 67/125 |

* cited by examiner

Package Receiving Device

Front Elevation

Rear Elevation

Package Receiving Device

Package Receiving Device

PACKAGE RECEIVING DEVICE

DETAILED DESCRIPTION OF THE DISCLOSURE

The non-limiting exemplary embodiment{s) will now be described more fully hereinafter with reference to the accompanying drawings, in which a preferred embodiment of the disclosure is shown. Such exemplary embodiment{s) may, however, be embodied in many different forms and should not be construed as limited to the embodiment set forth herein. Rather, these embodiment{s) are provided so that this application will be thorough and complete, and will fully convey the true scope of the disclosure to those skilled in the art.

The below disclosed subject matter is to be considered Illustrative, and not restrictive, and any appended claim{s) are intended to cover all such modifications, enhancements, and other embodiment{s) which fall within the true scope of the non-limiting exemplary embodiment{s). Thus, to the maximum extent allowed bylaw, the scope of the non-limiting exemplary embodiment{s) is to be determined by the broadest permissible interpretation of the claim{s) and their equivalents and shall not be restricted or limited by the foregoing detailed description.

References in the specification to "an exemplary embodiment", "an embodiment", "a preferred embodiment", "an alternative embodiment" and similar phrases mean that a particular feature, structure, or characteristic described in connection with the embodiment{s) is included in at least an embodiment of the disclosure. The appearances of the phrase "a non-limiting exemplary embodiment" in various places in the specification are not necessarily all meant to refer to the same embodiment.

As displayed in FIGS. 1-18, the package receiving device may include: The Upper Door Panel 1 may have an Area Hollowed Out 7 and centered on the inside surface of the Upper Door Panel 1 which may provide clearance for a Mailbox Assembly 13 which may pivot 90 degrees from a vertical closed position to a horizontal open position for the management of mail. There may be a Hole 10 bored through the outside front surface of the Upper Door Panel 1 near the top and centered for the installation of a Digital Deadbolt Assembly 10A. There may be a Hole 10B bored through the top surface of the Upper Door Panel 1 and centered for the deadbolt of the Digital Deadbolt Assembly 10A to travel through the Hole 2E of the upper horizontal Frame Panel 2C and into certain embodiments in order to lock the Upper Door Assembly 1 in place when closed. There may be a Channel 6 cut horizontally into the face and near the top of the Upper Door Panel 1 for a user to place their fingers in order to open the Upper Door Panel 1 90 degrees from the vertical closed position to the horizontal open position. An Opening 3 may be cut through the upper face area and centered in the Upper Door Panel 1 as a slot for depositing mail, magazines, and small packages into the Mailbox Assembly 13. A Mail Slot Door 3A may be mounted to an accompanying embodiment by a Spring Hinge 38. The Mail Slot Door 3A may open inward. A Flat Rubber Seal 3C may be mounted to a certain embodiment of the Mail Slot Door 3A as weatherproofing. There may be a Center Panel 4 positioned between the Upper Door Panel 1 and the Inside Panel 5. Center Panel 4 may have a Rectangular Cutout 4A near the top face and centered on the panel which may provide clearance for Mailbox Assembly 13 and Mailbox Door 3A to open to its fullest open position.

There may be a Hole 4B bored through Panel 4 near the top face and centered on the panel for the Digital Deadbolt Assembly 10. On the inside edges of the Rectangular Cutout 4A there may be a Hole 9 bored low in each vertical edge for a barbed Anchor 9A which will hold fast a Spring-Loaded Pin 9D which may fit into Holes 13E positioned low and near the front of the Mailbox Assembly 13 which may allow pivoting the Mailbox Assembly 13 from the closed vertical position to the open horizontal position. Inside Panel 5 may have a Rectangular Cutout SA near the top face and centered on the panel which may provide clearance for the Mailbox Assembly 13. There may be a Hole 5B bored through Panel 5 near the top face and centered on the panel for the Digital Deadbolt Assembly 10. The Upper Door Panel 1, Panel 4, and Panel 5 may be fastened together to move 2. There may be a Mailbox Assembly 13 comprised of one Horizontal Bottom 13A, two vertical Sides 13B, a Back 13C, and a Front 13D. The Mailbox Assembly 13 may be made of metal, wood, plastic, or other composite materials. The Mailbox Assembly 13 may be installed into the opening provided for it in Panels 4,5, and the Upper Door Panel 1 by pressing inward on the two Spring-Loaded Pins 9D so when released they seat into the shallow Holes 13E made near the bottom front on each side of the Mailbox Assembly 13. There may be two Hydraulic Struts 14 installed at a 45-degree angle when the Upper Door Panel 1 is in the open horizontal position. The ends of the Hydraulic Strut 14 may be connected to the inside surface of the Upper Door Panel 1 and the inside surface of the vertical Panels 2A and 28 of the Frame 2. The Hydraulic Struts 14 may control the movement of opening and closing the Upper Door Panel 1, Panel 4 and Panel 5 which are together as one unit. The Hydraulic Strut may be rated to support a load of 100 lbs.

The Hydraulic Strut 14 may be adjusted to keep the panel unit in the horizontal position as the user loads their package and pushes it through the Package Receiving Device. The Hydraulic Strut 14 may be adjustable to control the speed at which the panel unit opens and closes to achieve a safer environment for people, pets and packages. There may be a series of vertical Swinging Slats 11 and 12, attached to the underside of the horizontal top Frame Panel 2C of the Frame 2 which surround the package as it comes through the Package Receiving Device for the purpose of restricting ingress and egress there-through. The Narrow Slats 12 may use free swinging hinges. The Wide Slat 11 centered on the Frame 2 may use spring loaded hinges so the Wide Slat 11 will lock in the open position when raised to approximately 100 degrees. There may be Narrow Slats 12 left and right of the center Wide Slat 11. All the Swinging Slats 11, 12 open independently but may not open at the same time depending on the width of the package coming through the Package Receiving Device. For example, an average package may be narrower than the center Wide Slat 11 and when it is pushed through the Package Receiving Device, only the Wide Slat 11 will open thus leaving the Narrow Slats in their default closed position blocking any exit by a child or pet. The Swinging Slats 11 and 12 may be made slightly longer than the vertical space in which they are installed and may have a bevel cut at the bottom of each slat at approximately 7 degrees. This combination may make it impossible for the Swinging Slats 11 and 12 to be pushed outward from the inside space. The Swinging Slats 11 and 12 may be made of metal, Plexiglas, wood, or other composite materials.

The Wide Slat 11 may have a 2" Hole 11A near the bottom center area for the user to place fingers through in order to open the slat. The Wide Slat 11 may be made of clear Plexiglas so the user can see through it, when it is in its closed position, to see if there is mail in the Mailbox Assembly 13. The Mailbox Assembly 13 may have its Front Panel 13D made of clear Plexiglas so the user can see if there is mail in the mailbox. The Front Panel 13D of the Mailbox Assembly 13 may have a 2" hole bored through the upper centered area so a user may insert their fingers and pull the Mailbox Assembly 13 down 90 degrees, to the open horizontal position, for the management of mail. There may be a Package Stop 17 positioned on the inside face and at the bottom of Inside Panel 5. As a package is pushed through the package receiving device it may come to the point where it will clear the top panel 2C of the Frame 2. As Upper Door Panel 1 and Panels 4 and 5 are being closed from the horizontal position to the vertical position by the user the package slides on the inside face of the Inside Panel 5 towards the floor. Package Stop 17 may stop the package from traveling too fast to the floor and may be helpful in minimizing damage to a package. There may be a rubber seal 16 inserted in a groove 15 that may appear around the front perimeter of the Frame Assembly 2 which may repel inclement weather from entering the building. There may be Architectural Moldings 18 on the outside face of the Upper Door Panel that may hide the cutout that was made in the structure in which the Package Receiving Device is installed. The moldings may be made of Metal, Wood, Plastic or another composite material. The moldings may cover the cut-out and the front edges of Panels 2A,2B,2C and 2D providing a weatherproof seal. The Architectural Moldings 18 may be shaped to fit in with the motif and environment.

BACKGROUND OF THE INVENTION

Exemplary embodiment(s) of the present disclosure relate to devices for safely receiving a delivered package when an authorized user is not home and, more particularly, to a specially designed package receiving device configured to facilitate automatic receipt and notification of packages while preventing unauthorized ingress and egress therethrough. I have lost several packages from my front porch, due to "Porch Pirates", even though the cost may not be great, it is still a feeling of violation and disrupts our lives. I have a software app on my phone, which alerts me to crime events nearby. I can see that this is a big problem in need of a solution. Package lockers exist, which are at the post office, or fixed to the exterior of a building or to the ground. The security and convenience of this type of product, is inferior to my disclosure. Most are located at the post office or other location, and to retrieve your packages you must drive there, go in to the building, find your key or code, open the locker, retrieve your package, carry it to your car, put it in the car, drive home, open your other car door, carry your package while opening your front door, and putting your package down in the house while the door is still open enough for your animals and children to escape. Accordingly, the need remains or a package receiving device in order to overcome at least one of the above-noted shortcomings. The exemplary embodiment(s) satisfy such a need by a specially designed package receiving device that is convenient and easy to use, lightweight yet durable in design, versatile in its applications, and designed to facilitate automatic receipt and notification of packages, into your home or place of business while preventing unauthorized ingress and egress therethrough.

SUMMARY OF THE INVENTION

Figure 1:
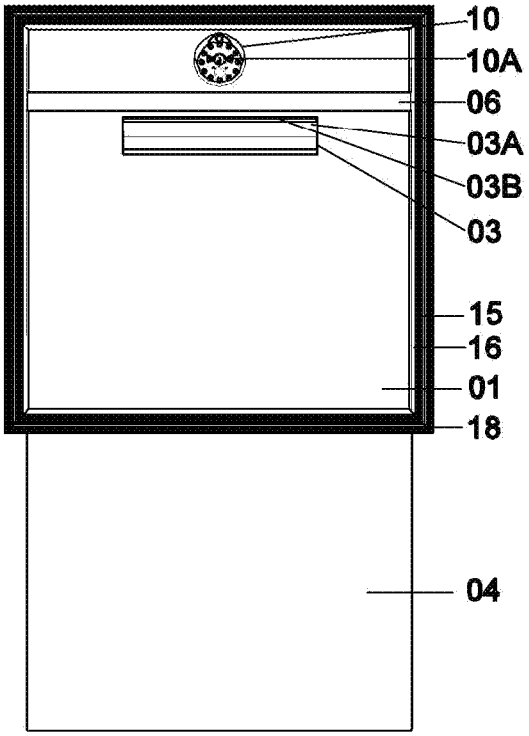
FIG. 1 is a front exterior elevation view of an exemplary embodiment of the present invention in a closed position with the mailbox door in the open position.
Figure 2:
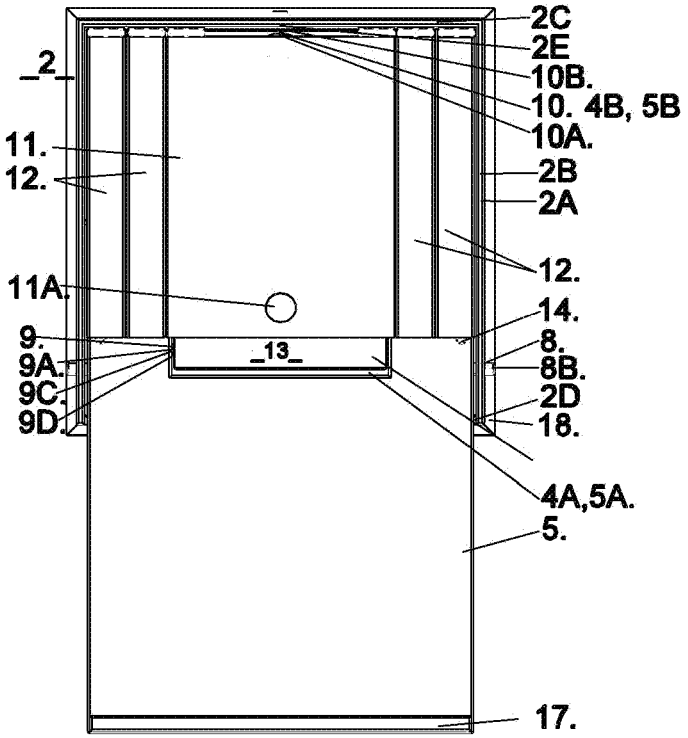
FIG. 2 is a back exterior elevation view of an exemplary embodiment of the present invention in a closed position.
Figure 3:
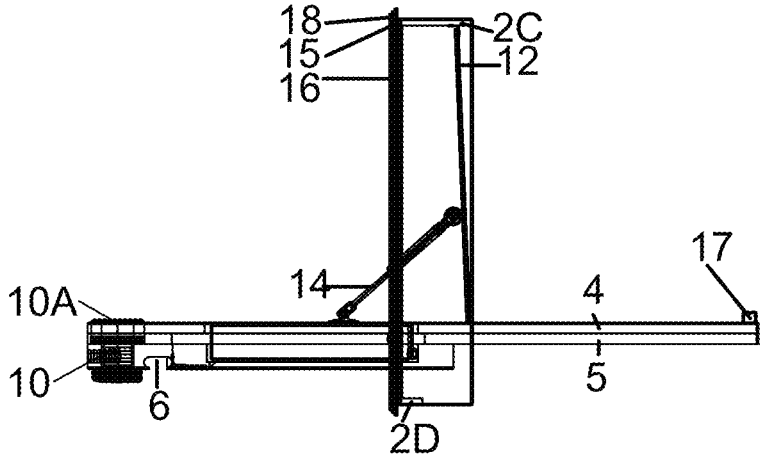
FIG. 3 is a right-side exterior wire view of an exemplary embodiment of the present invention in an open position.
Figure 4:
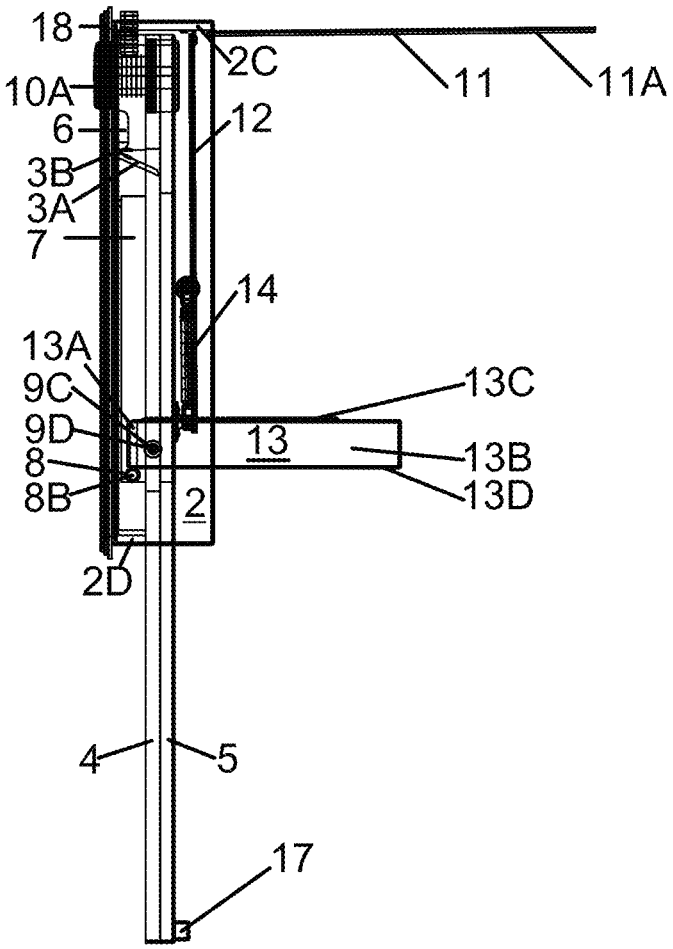
FIG. 4 is a right-side exterior wire view of an exemplary embodiment of the present invention in a closed position with the mailbox and wide slat in an open position.
Figure 5:
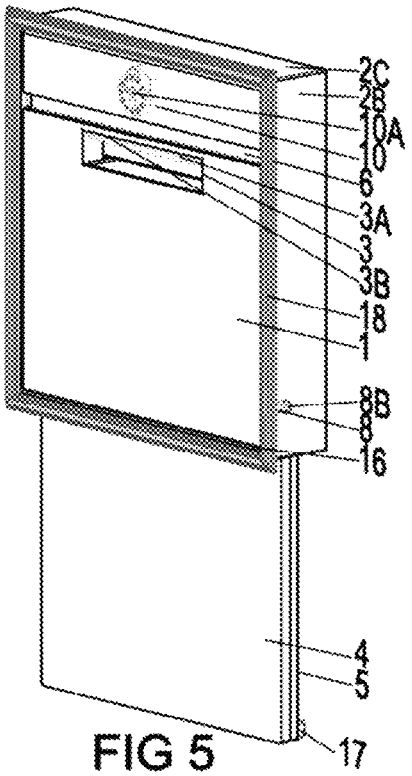
FIG. 5 is a right front perspective view of an exemplary embodiment of the present invention in a closed position.
Figure 6:
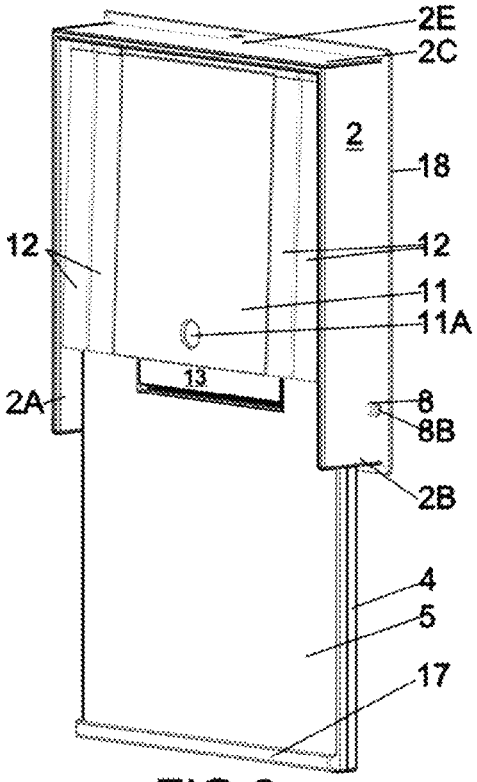
FIG. 6 is a right rear perspective view of an exemplary embodiment of the present invention in a closed position.

In a non-limiting exemplary embodiment, the package receiving device may be the simplest form of package delivery into the interior of a home or business. It is a unit comprised of a frame, a panel assembly, and solid steel pins. The panel assembly, which is a single unit, serves as the outside face of your door, when in the closed position. The longer panels, on the panel assembly, which are on the interior side of a residence provide the surface in which a package slides down safely to the floor. The panel assembly may be made with a compartment that houses a mailbox which a user may access from within the home or business. The package receiving device is not only installed in entry doors it may be installed in a wall or any vertical surface that would be prudent to accept deliveries of packages. The present disclosure may provide a weather tight portal through the entry door of a home or business. The access to the inside of your home or building is achieved by going through an open space in your door or wall. which is surrounded by a frame that contains a panel assembly which rotates on solid steel pins in a counterclockwise direction, from a vertical position to a horizontal position, much like that of an oven door. The panel assembly opens by pulling down, using your fingers, on an integral pull that is channeled into the upper front area of the panel assembly. The panel assembly and frame have a low impact on the existing architecture of the door or wall on your home or building.

SUMMARY OF THE INVENTION

The panel assembly closes itself in a controlled manner using pneumatic shock absorbers. When the panel assembly returns to the vertical closed position the deadbolt assembly may automatically lock the panel assembly in place. The deadbolt assembly may be unlocked by the couriers of firms such as FEDEX®, AMAZON®, USPS®, UPS® or any person you wish.

The user may enter a one-time authorization code generated by the owner's deadbolt assembly software. The owner places the authorization code into the shipping instructions area while making an on-line purchase. The courier may enter the authorization code and when the deadbolt assembly unlocks, he may open the panel assembly to a horizontal position which is approximately waist high from the floor, so the courier does not have to bend over while delivering packages. The courier may place the package on the panel assembly unit and push it through to a certain point. Then gravity pulls the panel assembly down and the package slides to the floor inside the home or business and then the panel assembly closes and locks.

What is claimed is:

1. A package receiving device comprising:

a frame including an elongated horizontal top rail member including a circular opening located in a front and center portion of said elongated horizontal top rail member wherein a deadbolt travels of a digital locking apparatus; a pattern of holes located on a back bottom portion of said elongated horizontal top rail member where hinges mount, a number of elongated swinging vertical slats fasten to said hinges;

said frame including an elongated horizontal bottom rail member;

said frame including an elongated right-side vertical member including a circular opening located near a bottom and front portion of said elongated right-side vertical member wherein a solid steel swivel pin installs connecting an upper panel door assembly to said frame;

said frame including an elongated left-side vertical member including a circular opening located near a bottom and front portion of said elongated left-side vertical member wherein a solid steel swivel pin installs;

said elongated left-side and right-side vertical members are spaced from one another and extend parallel to one another;

a respective end portion of said top rail member, said bottom rail member, and said elongated left-side and right-side vertical members are connected to form a rectangular shape forming a center opening having a height and width;

said horizontal top and bottom rail members and said left-side and right-side vertical members each containing a groove residing on a surface perpendicular to a front edge of said four frame members facilitating installing a rubber seal;

said upper door panel assembly comprising an elongated rectangular front panel includinga circular opening centrally located in an upper portion of said elongated front panel where said digital locking apparatus installs, a rectangular opening located centrally in said upper portion of said elongated front panel serving as a mail slot;

an elongated rectangular panel serving as a mail slot door including a spring hinge fastened to a back surface of said mail slot door and an adjacent surface;

a routing out of a width and depth located horizontally on an upper and front portion of said elongated front panel serving as a handle;

a circular opening located on lower left and right side edges of said elongated front panel where said solid steel swivel pins install;

a hollowed out portion located in an upper back side of said elongated front panel wherein a mailbox assembly installs;

an elongated rectangular center panel including a circular opening centrally located in an upper portion of the elongated center panel wherein said digital locking apparatus installs; a rectangular opening located in said upper portion of said elongated rectangular center panel wherein said mailbox assembly resides;

an elongated rectangular inside panel includes a circular opening centrally located in an upper portion of the elongated inside panel where said digital locking apparatus installs; a rectangular opening located in the upper portion of said elongated rectangular inside panel where said mailbox assembly installs; an elongated horizontal member located on a bottom back surface of said elongated rectangular inside panel serving as a removable package stop;

a back surface of said front panel connects to a front surface of said center panel; a front surface of said inside panel connects to a back surface of said center panel forming one coherent unit;

said upper panel door assembly mounts between said left-side and said right-side elongated vertical members of said frame by aligning said circular openings located on edges of said door front panel and said frame elongated vertical members; wherein said solid steel swivel pins install into respective aligned circular openings; wherein said upper door panel assembly pivotally rotates from a vertical closed position to a horizontal open position;

wherein pneumatic struts are installed at a forty five degree angle on said back surface of said front panel and inside surface of said right-side and left-side vertical members of said frame.

2. The package receiving device of claim 1 further comprising a larger circular opening on said center panel and said inside panel than the circular opening on said front panel, providing access to backside of said digital locking apparatus.

3. The package receiving device of claim 1, wherein said hinges include a number of free-swinging hinges and a number of self-closing hinges which connect said elongated swinging vertical slats to a bottom surface of said top rail of said frame.

4. The package receiving device of claim 1, wherein said elongated swinging vertical slats rotate upward as a package slides through, and when through, said vertical slats fall back to their home position preventing ingress and egress therethrough.

5. The package receiving device of claim 1, wherein said removable package stop fastens to the bottom of said backside of inside panel, wherein said package stop is removable to allow long packages through.

6. The package receiving device of claim 1, wherein said rubber seal has a barbed portion which inserts into a groove on inside surfaces and near the front of said frame members to seal weather from entering the interior of the home or business.

* * * * *